US007222459B2

(12) United States Patent
Taniyama

(10) Patent No.: US 7,222,459 B2
(45) Date of Patent: May 29, 2007

(54) SLIDING DOOR LOCKING SYSTEM

(75) Inventor: Masayuki Taniyama, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 286 days.

(21) Appl. No.: 11/107,390

(22) Filed: Apr. 15, 2005

(65) Prior Publication Data

US 2005/0236847 A1 Oct. 27, 2005

(30) Foreign Application Priority Data

Apr. 27, 2004 (JP) ..... 2004-131635

(51) Int. Cl.
*E05F 15/00* (2006.01)

(52) U.S. Cl. ..... 49/280; 292/216

(58) Field of Classification Search ..... 292/216, 292/201, DIG. 23, DIG. 46; 49/280
See application file for complete search history.

(56) References Cited

U.S. PATENT DOCUMENTS

| | | | | |
|---|---|---|---|---|
| 4,848,031 | A * | 7/1989 | Yamagishi et al. | 49/280 |
| 5,921,612 | A | 7/1999 | Mizuki et al. | |
| 6,032,987 | A | 3/2000 | Fukumoto et al. | |
| 6,942,258 | B2 * | 9/2005 | Roos | 292/201 |
| 2005/0099017 | A1 * | 5/2005 | Yoneyama et al. | 292/216 |

FOREIGN PATENT DOCUMENTS

| | | |
|---|---|---|
| DE | 197 32 420 C2 | 2/1998 |
| DE | 60100720 T | 7/2004 |
| EP | 1205619 A1 | 5/2002 |
| JP | 2003-097121 | 4/2003 |

* cited by examiner

*Primary Examiner*—Gary Estremsky
(74) *Attorney, Agent, or Firm*—Carrier Blackman & Associates, P.C.; Joseph P. Carrier; William D. Blackman

(57) ABSTRACT

A sliding door locking system includes: a plurality of latch mechanisms including a front latch mechanism mounted on a front part of the sliding door; an outside handle mechanism disposed outwardly of a windowpane of the sliding door; and a remote control mechanism provided in the sliding door inwardly of the windowpane so as to exert on each of the latch mechanisms an operating force from the outside handle mechanism. A first transmission cable for transmitting the operating force from the outside handle mechanism extends to the front latch mechanism side while bypassing the windowpane. The first transmission cable and a second transmission which is cable for transmitting to the remote control mechanism an operating force transmitted from the first transmission cable to a relay lever, are coupled to the relay lever. The relay lever is pivotably supported in a casing of the front latch mechanism and positioned inwardly of the windowpane.

2 Claims, 5 Drawing Sheets

SLIDING DOOR LOCKING SYSTEM

RELATED APPLICATION DATA

The Japanese priority application No. 2004-131635, upon which the present application is based, is hereby incorporated in its entirety herein by reference.

BACKGROUND OF THE INVENTION

1. Field of the Invention

The present invention relates to a sliding door locking system that includes: a plurality of latch mechanisms including a front latch mechanism in which a latch capable of maintaining a sliding door in a closed state by engaging with a striker on a vehicle body is pivotably supported in a casing mounted on a front part of the sliding door; an outside handle mechanism disposed outwardly of a windowpane of the sliding door so as to enable handle operation outside the sliding door; and a remote control mechanism provided in the sliding door inwardly of the windowpane so as to exert on each of the latch mechanisms an operating force according to the handle operation of the outside handle mechanism.

2. Description of the Related Art

Such a locking system is already known from, for example, Japanese Patent Application Laid-open No. 2003-97121.

In such a sliding door locking system, it is necessary to transmit an operating force from the outside handle mechanism which is on the outward side of the windowpane, to the remote control mechanism side which is inward of the windowpane. In this conventional arrangement, a pivoting shaft is pivotably disposed in a front part of the sliding door at a position corresponding to the outside handle mechanism, an outside handle of the outside handle mechanism is coupled to an outer end of the pivoting shaft via a swinging link, and the remote control mechanism is coupled to an inner end of the pivoting shaft via a transmission link.

In this conventional arrangement, since it is necessary to employ a component for pivotably supporting the pivoting shaft in the sliding door, the number of components is relatively large, and since it is necessary to assemble the pivoting shaft to the sliding door, the number of assembly steps increases.

SUMMARY OF THE INVENTION

The present invention has been accomplished under the above-mentioned circumstances, and it is an object thereof to provide a sliding door locking system that enables an operating force to be transmitted from the outside handle a mechanism to the remote control mechanism while reducing the number of components and the number of assembly steps.

In order to achieve the above-mentioned object, according to a first feature of the invention, there is provided a sliding door locking system comprising: a plurality of latch mechanisms including a front latch mechanism in which a latch capable of maintaining a sliding door in a closed state by engaging with a striker on a vehicle body is pivotably supported in a casing mounted on a front part of the sliding door; an outside handle mechanism disposed outwardly of a windowpane of the sliding door so as to enable handle operation outside the sliding door; a remote control mechanism provided in the sliding door inwardly of the windowpane so as to exert on each of the latch mechanisms an operating force according to the handle operation of the outside handle mechanism; wherein the system further comprises: a first transmission cable for transmitting the operating force from the outside handle mechanism, the first transmission cable extending to the front latch mechanism side while bypassing the windowpane; a relay lever pivotably supported in the casing and positioned inwardly of the windowpane; and a second transmission cable for transmitting to the remote control mechanism an operating force transmitted from the first transmission cable to the relay lever, the first transmission cable and the second transmission cable being coupled to the relay lever.

According to a second feature of the present invention, in addition to the first feature, the system further comprises a lock release actuator for making an operating force for releasing a locked state act on each of the latch mechanisms, the lock release actuator being coupled to the relay lever.

With the arrangement of the first feature, the operating force from the outside handle mechanism is transmitted to the remote control mechanism via the first transmission cable, the relay lever, and the second transmission cable, and it is the first transmission cable that links the relay lever to the outside handle mechanism. Therefore, it is easy to dispose the first transmission cable so as to bypass the windowpane. Further, since the relay lever is pivotably supported in the casing of the front latch mechanism, it is unnecessary to assemble to the sliding door any component used exclusively for pivotably supporting the relay lever besides the front latch mechanism, thus reducing the number of components. Furthermore, since it is unnecessary to assemble only the relay lever to the sliding door separately from the assembly of the front latch mechanism to the sliding door, the number of assembly steps can be reduced.

With the arrangement of the second feature, since the operating force from the lock release actuator is also input into the relay lever, the power transmission route between the lock release actuator and the remote control mechanism can be simplified, thus further reducing the number of components. Moreover, disposing the lock release actuator in the vicinity of the front latch mechanism enables the operating force from the lock release actuator to be applied to all the latch mechanisms while shortening the transmission route.

The above-mentioned object, other objects, characteristics, and advantages of the present invention will become apparent from a preferred embodiment that will be described in detail below by reference to the attached drawings.

DESCRIPTION OF THE PREFERRED EMBODIMENT

Figure 1:
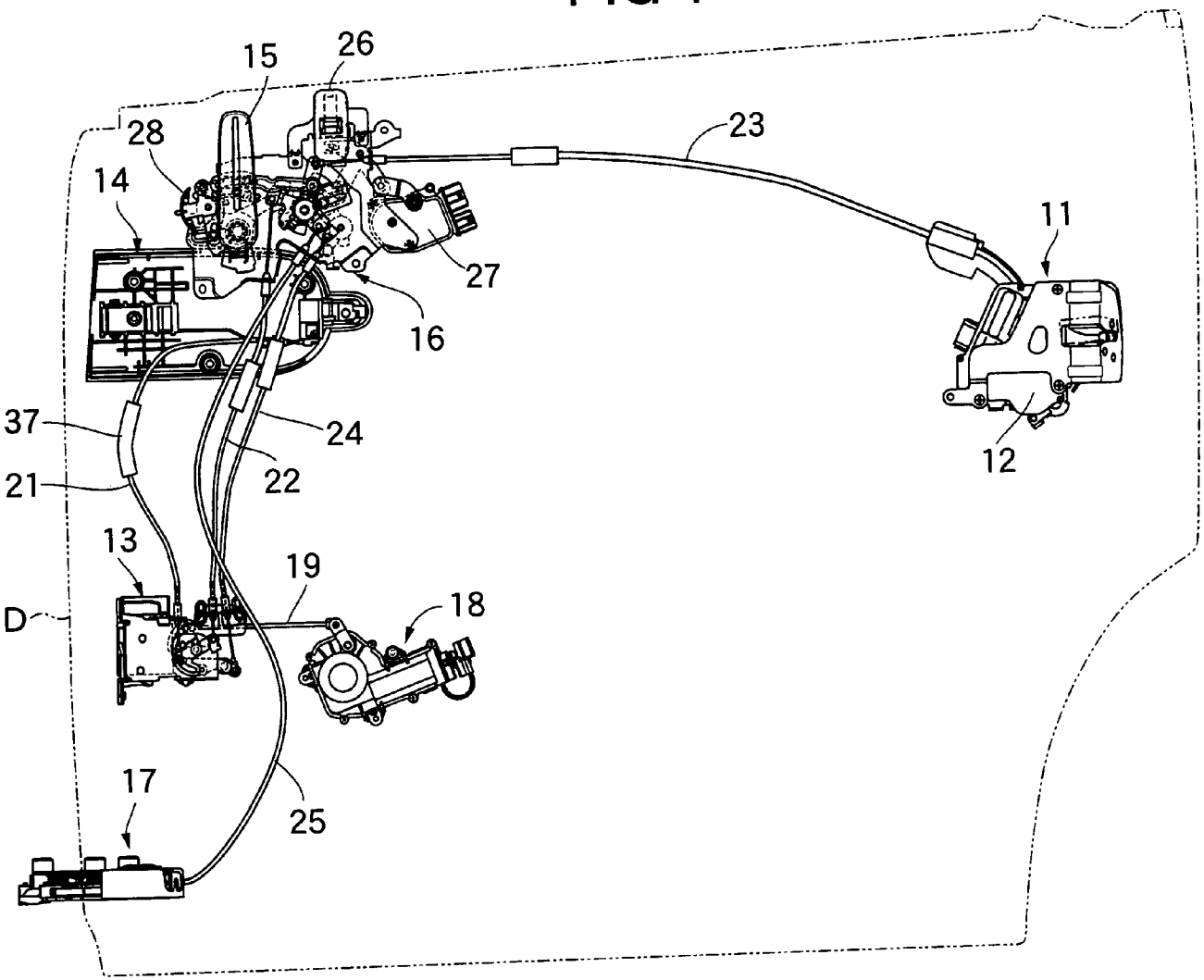
FIG. 1 is a front view taken from inside, of a sliding door including a locking system according to one embodiment of the present invention.

Referring firstly to FIG. 1, a sliding door D is mounted on the right-hand side of a vehicle body (not illustrated) so that the sliding door D can slide in the fore-and-aft direction between a closed position on the front side (the left side in FIG. 1) and an open position on the rear side (the right side in FIG. 1). The sliding door D can be automatically opened and closed by an electric door opening/closing system (not illustrated).

The sliding door D is provided in a rear part thereof with a rear latch mechanism 11 that engages with the vehicle body when the sliding door D is in its closed state, to maintain the closed state. The rear latch mechanism 11 includes a locking operation actuator 12 for putting the sliding door D in a fully closed state. The sliding door D is provided in a front part thereof with a front latch mechanism 13 that engages with the vehicle body when the sliding door D is in its closed state, to maintain the closed state. An outside handle mechanism 14 is provided in an upper front part of the sliding door D above the front latch mechanism 13, to enable handle operation on the outside of the sliding door D. A remote control mechanism 16 has an inside handle 15 disposed on the inside of the sliding door D, and is provided in an upper part of the sliding door D rearward of the outside handle mechanism 14. A lower latch mechanism 17 is provided in a front part of the sliding door D beneath the front latch mechanism 13. The lower latch mechanism 17 engages with the vehicle body when the sliding door D is in its open state, to maintain the open state. A lock release actuator 18 is mounted on the sliding door D rearward of the front latch mechanism 13. The lock release actuator 18 is capable of giving power for releasing the lock to the rear latch mechanism 11, the front latch mechanism 13, and the lower latch mechanism 17.

An operating force exhibited by the lock release actuator 18 is transmitted to the front latch mechanism 13 via a rod 19. An operating force accompanying operation of the outside handle mechanism 14 is transmitted to the front latch mechanism 13 via a first transmission cable 21. The front latch mechanism 13 converts either the operating force transmitted from the lock release actuator 18 or the operating force transmitted from the outside handle mechanism 14 into a pulling power of a second transmission cable 22 while avoiding mutual interference between the lock release actuator 18 and the outside handle mechanism 14. This operating force for releasing the lock that has been transmitted from the second transmission cable 22 to the remote control mechanism 16 is transmitted to the rear latch mechanism 11, the front latch mechanism 13, and the lower latch mechanism 17 via third, fourth, and fifth transmission cables 23, 24, and 25. The remote control mechanism 16 is also capable of transmitting the operating force for releasing the lock accompanying operation of the inside handle 15 directly to the third, fourth, and fifth transmission cables 23, 24, and 25.

When a switching operation for opening the sliding door D is carried out in a driver's seat while the sliding door D is in the closed state, the lock release actuator 18 operates, the power transmitted from the lock release actuator 18 to the front latch mechanism 13 via the rod 19 is transmitted to the remote control mechanism 16 via the second transmission cable 22, and power for releasing the lock is transmitted from the remote control mechanism 16 to the rear latch mechanism 11 and the front latch mechanism 13 via the third and fourth transmission cables 23 and 24. This puts the rear and front latch mechanisms 11 and 13 in an unlocked state, the sliding door D is automatically opened by the electric door opening/closing system, and the lower latch mechanism 17 carries out a locking operation while the sliding door D is in a fully open state, thus maintaining the sliding door D in the fully open state.

When a switching operation for closing the sliding door D is carried out in the driver's seat while the sliding door D is in an open state, the lock release actuator 18 operates, the power transmitted from the lock release actuator 18 to the front latch mechanism 13 via the rod 19 is transmitted to the remote control mechanism 16 via the second transmission cable 22, and power for releasing the lock is transmitted from the remote control mechanism 16 to the lower latch mechanism 17 via the fifth transmission cable 25. This puts the lower latch mechanism 17 in an unlocked state, and the sliding door D is automatically closed by the electric door opening/closing system. In this process, the rear latch mechanism 11 carries out a locking operation so as to achieve a fully closed state out of a half-closed state of the sliding door D, by starting an operation of the locking operation actuator 12, and the front latch mechanism 13 accordingly carries out a locking operation, thus maintaining the sliding door D in the fully closed state.

On the other hand, when an opening operation is carried out with the inside handle 15 while the sliding door D is in a closed state, the lock release actuator 18 operates in accordance with this opening operation; the front latch mechanism 13, the remote control mechanism 16, the rear latch mechanism 11, and the lock release actuator 18 operate as in the case where the switching operation for opening the sliding door D is carried out in the driver's seat; the sliding door D is automatically opened by the electric door opening/closing system; and the lower latch mechanism 17 carries out a locking operation while the sliding door D is in a fully open state, thus maintaining the sliding door D in the fully open state.

When a closing operation is carried out with the inside handle 15 while the sliding door D is in an open state, the lock release actuator 18 operates in accordance with this closing operation; the front latch mechanism 13, the remote control mechanism 16, and the lower latch mechanism 17 operate as in the case where the switching operation for closing the sliding door D is carried out in the driver's seat; the sliding door D is automatically closed by the electric door opening/closing system; the rear latch mechanism 11 carries out a locking operation so as to achieve a fully closed state out of a half-closed state of the sliding door D, by starting an operation of the locking operation actuator 12; and the front latch mechanism 13 accordingly carries out a locking operation, thus maintaining the sliding door D in the fully closed state.

Also when a handle operation of the outside handle mechanism 14 is carried out, the lock release actuator 18, the front latch mechanism 13, the remote control mechanism 16, the rear latch mechanism 11, and the lower latch mechanism 17 operate in the same manner as in the above-mentioned operation of the inside handle 15.

The remote control mechanism 16 includes: a lock knob 26 that moves between an upper unlock position and a lower lock position in accordance with a manual operation; a lock switching actuator 27 that moves the lock knob 26 in accordance with an operation in the driver's seat; and a child lock knob 28 that moves between an unlock position and a lock position in accordance with a manual operation; as well as switches (not illustrated) that detect an operation of the inside handle 15 and an operation input from the outside handle mechanism 14 via the first transmission cable 21, the front latch mechanism 13, and the second transmission cable 22.

The remote control mechanism 16 is arranged so that, when the lock switching actuator 27 moves the lock knob 26 to the lock position in accordance with an operation in the driver's seat, or when the lock knob 26 is manually operated to the lock position, an operating force due to operation of the inside handle 15 and a force transmitted from the second transmission cable 22 are not transmitted to the third and fourth cables 23 and 24. Further, the remote control mechanism 16 is arranged so that, when the child lock knob 28 is operated to the lock position while the lock knob 26 is in the unlock position, an operating force accompanying operation of the inside handle 15 is not transmitted to the third and fourth transmission cables 23 and 24, and the lock release actuator 18 is maintained in a non-operating state without detecting an opening operation of the inside handle 15. Therefore, while the sliding door D is in a closed locked state, even if an opening operation of the inside handle 15 or an opening operation of the outside handle mechanism 14 is carried out, the rear latch mechanism 11 and the front latch mechanism 13 will not operate so as to release the locked state.

Although the lock release actuator 18 is essential for a locking system for a power slide type sliding door D equipped with an electric door opening/closing system, when the lock release actuator 18 malfunctions, it is still possible to release the locked state of the rear latch mechanism 11, the front latch mechanism 13, and the lower latch mechanism 17. That is, the remote control mechanism 16 can transmit, directly to the third, fourth, and fifth transmission cables 23, 24, and 25, an operating force for releasing the lock transmitted via the first transmission cable 21, the front latch mechanism 13, and the second transmission cable 22 accompanying operation of the outside handle mechanism 14, and an operating force for releasing the lock accompanying operation of the inside handle 15; when the lock release actuator 18 malfunctions, the locked state of the rear latch mechanism 11, the front latch mechanism 13, and the lower latch mechanism 17 can still be released by mechanical transmission of the operating force accompanying operation of the outside handle mechanism 14 or operation of the inside handle 15.

Figure 2:
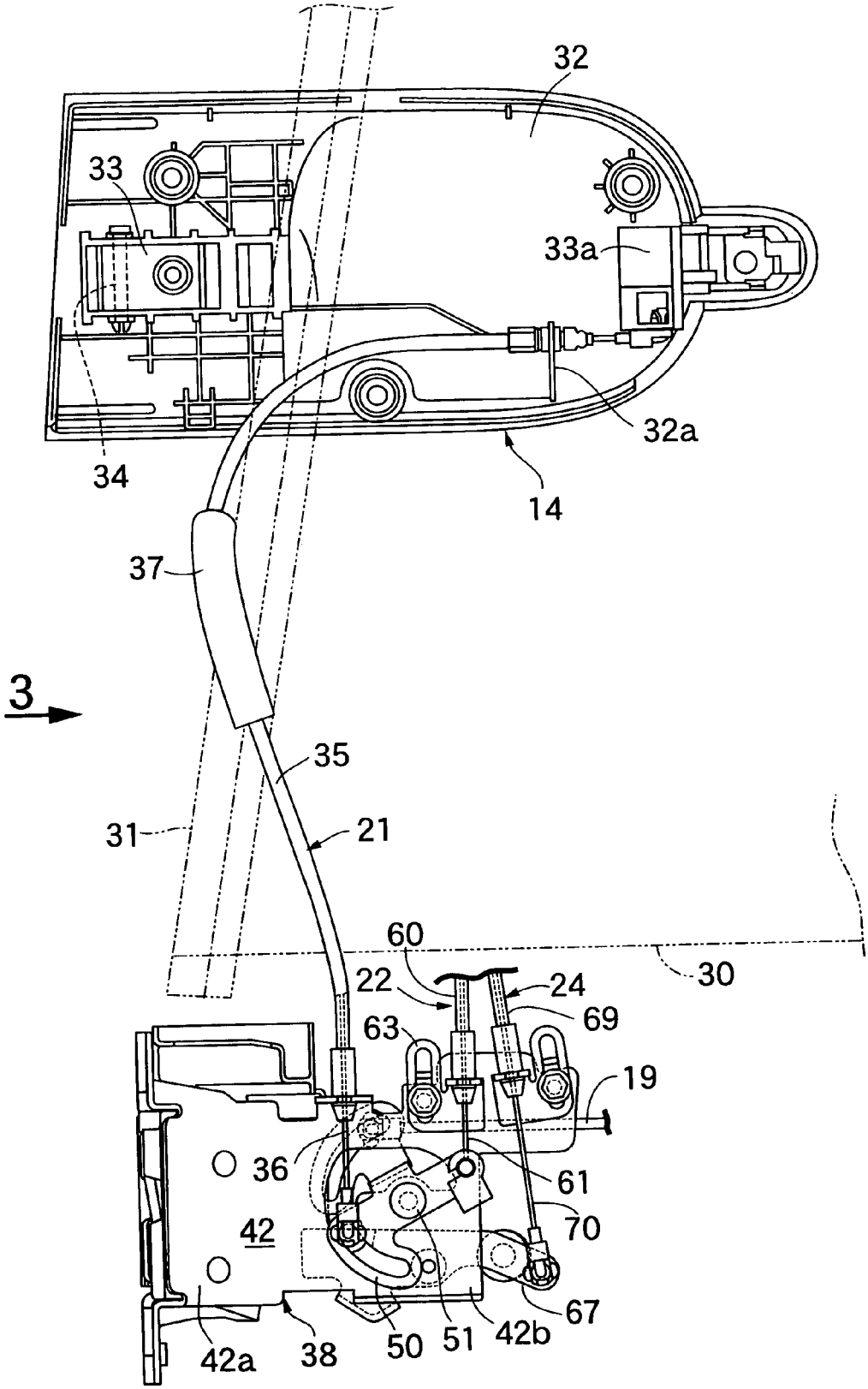
FIG. 2 is a front view taken from the inner side of the sliding door, of an outside handle mechanism and a front latch mechanism.
Figure 3:
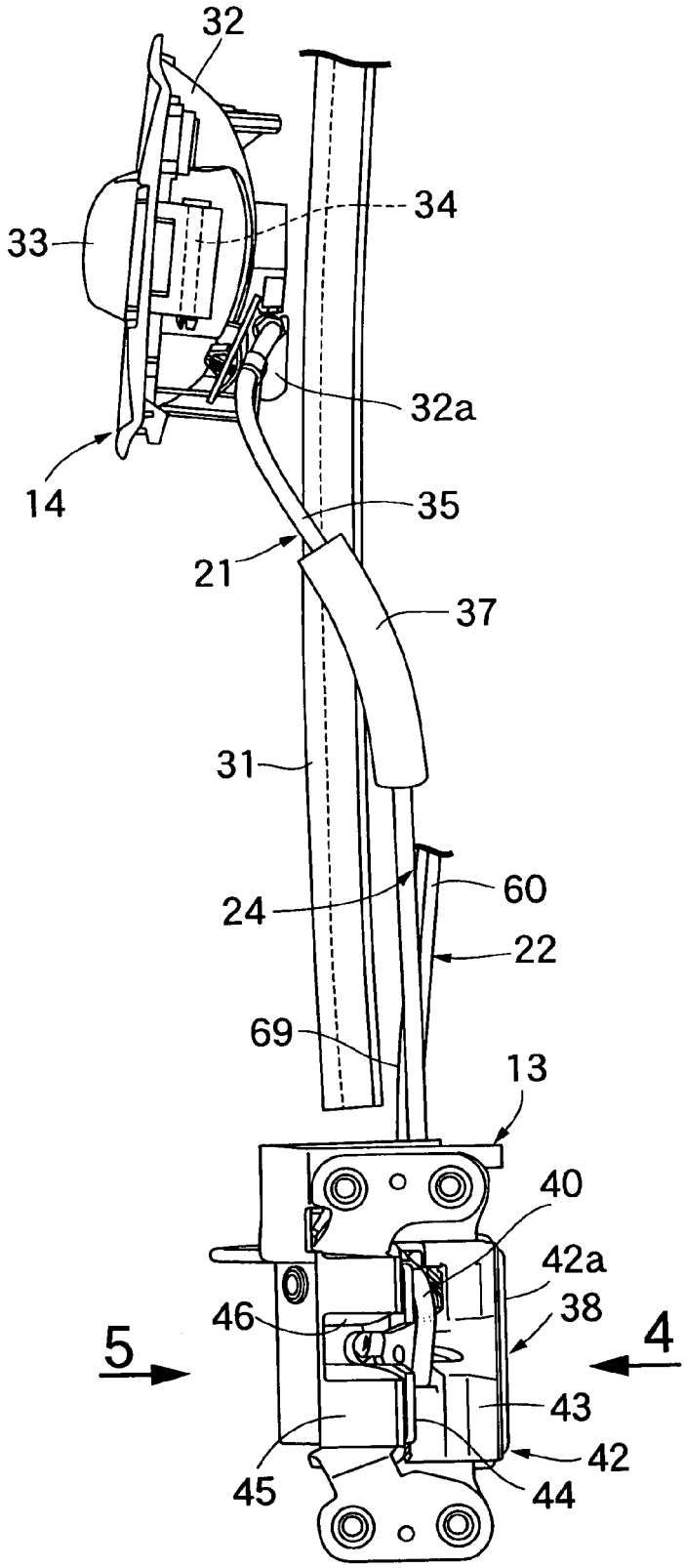
FIG. 3 is a view taken from the direction of arrow 3 in FIG. 2.

In FIG. 2 and FIG. 3, the sliding door D includes an outer panel and an inner panel (not illustrated); a windowpane 30 is disposed between the outer panel and the inner panel, and can be raised and lowered while being guided by a runner 31. The outside handle mechanism 14 is provided on the outer panel outwardly of the windowpane 30, the remote control mechanism 16 is provided on the inner panel inwardly of the windowpane 30. The front latch mechanism 13 is provided on the inner panel beneath the windowpane 30.

The outside handle mechanism 14 is formed by pivotably mounting via a support shaft 34 a front part of the outside handle 33, which extends in the fore-and-aft direction of the vehicle body, in a front part of a handle case 32 mounted on the outer panel of the sliding door D. One end of the first transmission cable 21 is coupled to a connecting portion 33*a* provided integrally with a rear part of the outside handle 33 so as to run through the handle case 32 and project into the outer panel.

The first transmission cable 21 is formed from an inner cable 36 movably passed through an outer cable 35; one end of the outer cable 35 is fixedly supported by a cable support portion 32*a* provided integrally with the handle case 32, and one end of the inner cable 36 projecting from said one end of the outer cable 35 is coupled to the connecting portion 33*a*.

The first transmission cable 21 extends from the outside handle mechanism 14 to the front latch mechanism 13 side while bypassing the windowpane 30. A cylindrical elastic cover 37 attached to the outer cable 35 in a longitudinally middle section of the first transmission cable 21 is wrapped around the runner 31 so as to curve from the outer side to the inner side.

Figure 4:
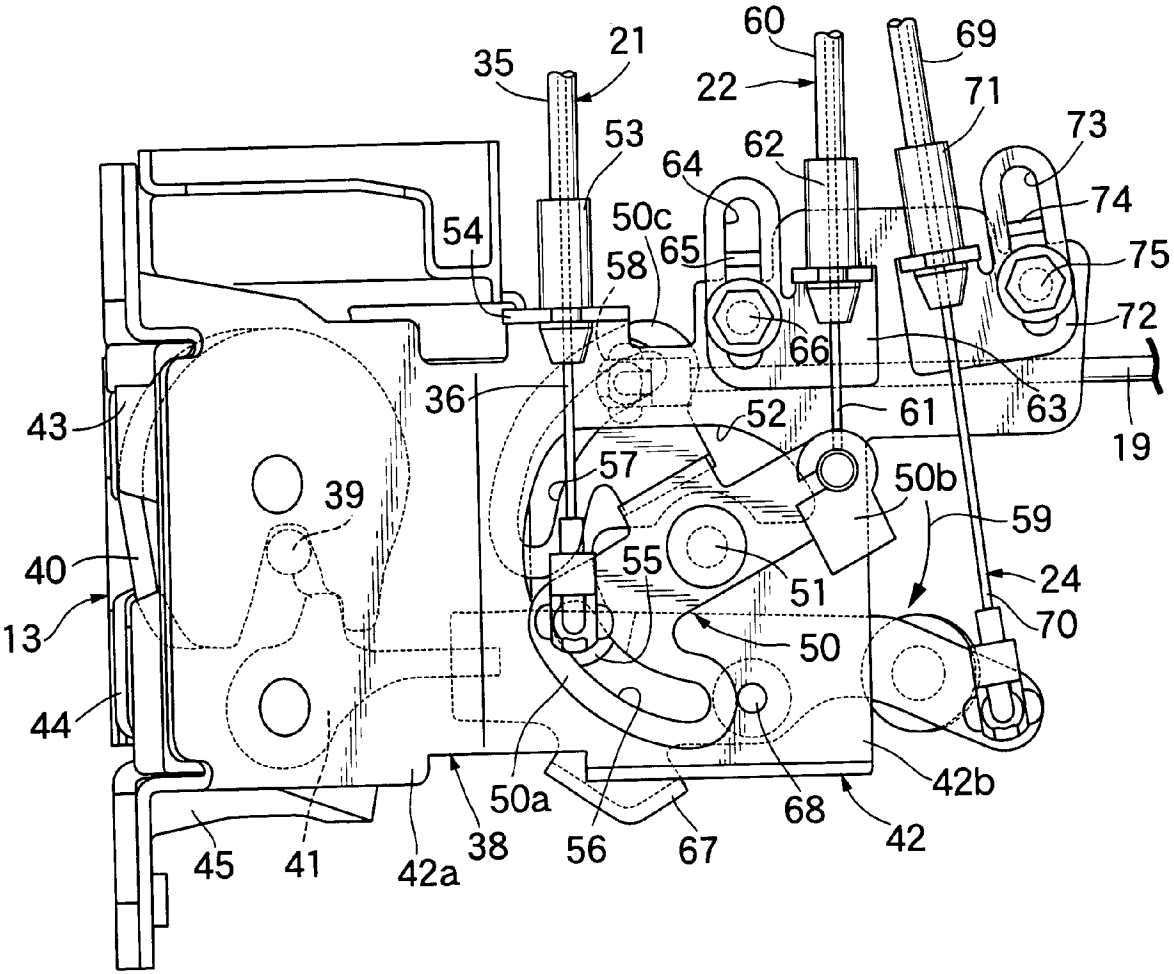
FIG. 4 is an enlarged view taken from the direction of arrow 4 in FIG. 3.
Figure 5:
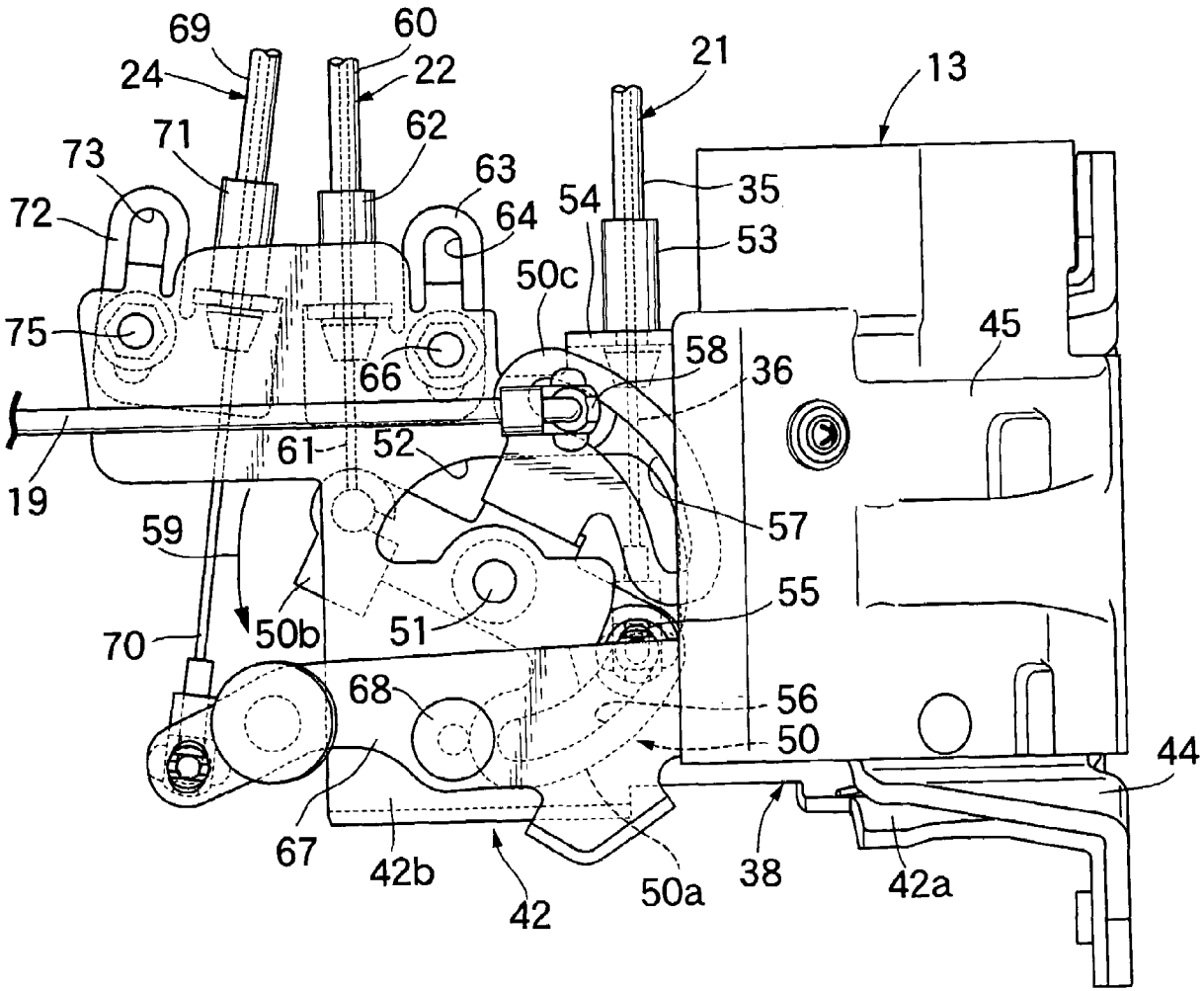
FIG. 5 is an enlarged view taken from the direction of arrow 5 in FIG. 3.

Referring in addition to FIG. 4 and FIG. 5, the front latch mechanism 13 includes: a casing 38 mounted on a front part of the inner panel of the sliding door D; a latch 40 supported in the casing 38 so as to be capable of pivoting by engaging with a striker 39 (see FIG. 4) on the vehicle body when the sliding door D moves from an open state to a closed state; and a ratchet 41 that maintains an engaged state of the striker 39 with the latch 40 by engaging with the latch 40 in a state in which it has engaged with the striker 39 and pivoted. The latch 40 is spring-biased to a side in which engagement with the striker 39 is released, and the ratchet 41 is spring-biased in a direction in which the ratchet 41 engages with the latch 40.

The casing 38 is formed from a metal base plate 42, a synthetic resin case 43 housed in a substantially U-shaped housing portion 42*a* provided in the base plate 42, a metal sheet 44, the case 43 being sandwiched between the metal sheet 44 and the base plate 42, and a synthetic resin cover 45 covering a part of the metal sheet 44.

This casing 38 is provided with an insertion opening 46, into which the striker 39 is removably inserted. The latch 40 is disposed between the case 43 and the metal sheet 44 so that a part of the latch 40 faces the insertion opening 46. The latch 40 and the ratchet 41 are supported in the casing 38 so that they can pivot around axes that are parallel to each other.

The base plate 42 integrally includes a support plate portion 42*b* protruding sideways from the housing portion 42*a*. A relay lever 50 is pivotably supported on this support plate portion 42*b* via the support shaft 51 which has an axis parallel to the pivoting axes of the latch 40 and the ratchet 41.

The relay lever 50 has integral first and second cable connecting portions 50*a* and 50*b* disposed on one side of the support plate portion 42*b*, and a rod connecting portion 50*c* disposed on the other side of the support plate portion 42*b*. The support plate portion 42*b* is provided with an opening 52 through which a part of the relay lever 50 runs such that the pivoting movement of the relay lever 50 is not obstructed.

A cable end 53 fixed to an end on the front latch mechanism 13 side of the outer cable 35 of the first transmission cable 21 is fixedly supported by a cable support portion 54 provided integrally with an upper part of the support plate portion 42*b* of the base plate 42. An engagement piece 55 provided at the end of the inner cable 36 projecting from the cable end 53, slidably engages with a first engagement hole 56 provided in the first cable connecting portion 50*a* of the relay lever 50. The first engagement hole 56 is formed in an arc shape that conforms to an imaginary circle having the axis of the support shaft 51 as its center.

The rod connecting portion 50*c* of the relay lever 50 is provided with a second engagement hole 57 formed in an arc shape that conforms to the imaginary circle to which the first engagement hole 56 conforms. An engagement piece 58 provided at the extremity of the rod 19, which extends from the lock release actuator 18, slidably engages with the second engagement hole 57.

The second transmission cable 22 is formed from an inner cable 61 movably passed through an outer cable 60. The end of the inner cable 61 on the front latch mechanism 13 side is coupled to the second cable connecting portion 50*b* of the relay lever 50.

When the outside handle 33 of the outside handle mechanism 14 is operated, an upward pulling force acts on the first transmission cable 21, and the rod 19 is pulled toward the lock release actuator 18 in accordance with operation of the lock release actuator 18. As a result of such operating forces transmitted from the first transmission cable 21 and the rod 19, the relay lever 50 pivots in a transmission pivoting direction (the clockwise direction in FIG. 4 and the anticlockwise direction in FIG. 5) shown by the arrow 59 so as to pull the second transmission cable 22 downward. In order to convert either the operating force transmitted from the outside handle mechanism 14 or the operating force transmitted from the lock release actuator 18 into a pulling force for the second transmission cable 22 while avoiding mutual interference between the lock release actuator 18 and the outside handle mechanism 14, when the outside handle mechanism 14 is in a non-operated state and the lock release actuator 18 is in a non-operated state, the engagement piece 55 fixed to the inner cable 36 of the first transmission cable 21 and the engagement piece 58 fixed to the rod 19 are set so as to be positioned at the lower ends, along the transmission pivoting direction 59 of the relay lever 50, of the first and second engagement holes 56 and 57.

A cable end 62 fixed to the end on the front latch mechanism 13 side of the outer cable 61 of the second transmission cable 22 is fixedly supported by a first stay 63 fixed to an upper part of the support plate portion 42*b* of the base plate 42 so that the position of the cable end 62 can be adjusted in a limited range along the longitudinal direction of the second transmission cable 22. That is, the first stay 63 is provided with an oblong through-hole 64 which is long along the longitudinal direction of the second transmission cable 22, and a projection 65 is projectingly provided integrally on the support plate portion 42*b* and fitted into the through-hole 64.

A bolt 66 is inserted into the through-hole 64; screwing and tightening the bolt 66 into the support plate portion 42*b* enables the first stay 63 to be secured to the support plate portion 42*b*. Since the projection 65 is fitted into the through-hole 64, the first stay 63 can be secured to the support plate portion 42*b* by the single bolt 66. Moreover, by adjusting the position of the bolt 66 along the longitudinal direction of the oblong through-hole 64, the first stay 63 is secured to the support plate portion 42*b* so that the position of the first stay 63 can be changed in the limited range, thereby adjusting the length of the second transmission cable 22.

A release lever 67 having one end thereof engaged with the ratchet 41 is disposed beneath the relay lever 50. A middle section of the release lever 67 is pivotably supported in a lower part of the support plate portion 42*b* by the support shaft 68, which is disposed beneath the support shaft 51 and which has an axis parallel to the support shaft 51.

A pivoting force is transmitted from the fourth transmission cable 24 to the release lever 67 accompanying operation of the remote control mechanism 16. When the release lever 67 is pivoted by the fourth transmission cable 24 in the anticlockwise direction in FIG. 4 (the clockwise direction in FIG. 5), the ratchet 41 is pivoted so as to release the engagement with the latch 40, thereby releasing the closed locked state of the sliding door D caused by the front latch mechanism 13.

The fourth transmission cable 24 is formed from an inner cable 70 movably passed through an outer cable 69. The end of the inner cable 70 on the front latch mechanism 13 side is coupled to the other end of the release lever 67.

A cable end 71 fixed to the end on the front latch mechanism 13 side of the outer cable 69 of the fourth transmission cable 24 is fixedly supported by a second stay 72 disposed in an upper part of the support plate portion 42*b* so as to be adjacent to the first stay 63. The second stay 72 is fixed to the support plate portion 42*b* so that the position of the second stay 72 can be adjusted in a limited range along the longitudinal direction of the fourth transmission cable 24. That is, the second stay 72 is provided with an oblong through-hole 73 which is long along the longitudinal direction of the fourth transmission cable 24, and a projection 74 is projectingly provided integrally on the support plate portion 42*b* and fitted into the insertion hole 73.

A bolt 75 is inserted through the insertion hole 73; screwing and tightening the bolt 75 into the support plate portion 42*b* enables the second stay 72 to be secured to the support plate portion 42*b*. Since the projection 74 is fitted into the insertion hole 73, the second stay 72 can Secured to the support plate portion 42*b* by the single bolt 75. Moreover, by adjusting the position of the bolt 75 along the longitudinal direction of the oblong insertion hole 73, the second stay 72 is secured to the support plate portion 42*b* so that the position of the second stay 72 can be changed in the limited range, thereby adjusting the length of the fourth transmission cable 24.

The operation of this embodiment is now explained. The first transmission cable 21 for transmitting an operating force from the outside handle mechanism 14 extends to the front latch mechanism 13 side while bypassing the windowpane 30. The first transmission cable 21 and the second transmission cable 22 are coupled to the relay lever 50, which is pivotably supported in the casing 38 of the front latch mechanism 13 and is positioned inwardly of the windowpane 30. The second transmission cable 22 transmits to the remote control mechanism 16 an operating force transmitted from the first transmission cable 21 to the relay lever 50.

That is, since the operating force from the outside handle mechanism 14 is transmitted to the remote control mechanism 16 via the first transmission cable 21, the relay lever 50, and the second transmission cable 22, and the first transmission cable 21 links the relay lever 50 to the outside handle mechanism 14, an arrangement in which the windowpane 30 is bypassed is easily provided. Further, since the relay lever 50 is pivotably supported in the casing 38 of the front latch mechanism 13, it is unnecessary to mount on the sliding door D any component used exclusively for pivotably supporting the relay lever 50 besides the front latch mechanism 13, thus reducing the number of components. Furthermore, since it is unnecessary to assemble only the relay lever 50 to the sliding door D separately from the assembly of the front latch mechanism 13 to the sliding door D, the number of assembly steps can be reduced.

Further, since the lock release actuator 18 for applying an operating force for releasing the locked state to the rear latch mechanism 11, the front latch mechanism 13, and the lower latch mechanism 17 is coupled to the relay lever 50, it is possible to simplify the power transmission route between the lock release actuator 18 and the remote control mechanism 16, thus further reducing the number of components. Furthermore, by disposing the lock release actuator 18 in the vicinity of the front latch mechanism 13, it is possible to apply the operating force from the lock release actuator 18 to all the latch mechanisms 11, 13, and 17 while shortening the transmission route.

Although an embodiment of the present invention has been described above, the present invention can be modified in a variety of ways without departing from the subject matter thereof.

What is claimed is:

1. A sliding door locking system comprising:

a plurality of latch mechanisms including a front latch mechanism in which a latch capable of maintaining a sliding door in a closed state by engaging with a striker on a vehicle body is pivotably supported in a casing mounted on a front part of the sliding door;

an outside handle mechanism disposed outwardly of a windowpane of the sliding door so as to enable handle operation outside the sliding door;

a remote control mechanism provided in the sliding door inwardly of the windowpane so as to exert on each of the latch mechanisms an operating force according to the handle operation of the outside handle mechanism;

wherein the system further comprises:

a first transmission cable for transmitting the operating force from the outside handle mechanism, the first transmission cable extending to the front latch mechanism side while bypassing the windowpane;

a relay lever pivotably supported in the casing and positioned inwardly of the windowpane; and a second transmission cable for transmitting to the remote control mechanism an operating force transmitted from the first transmission cable to the relay lever, the first transmission cable and the second transmission cable being coupled to the relay lever.

2. The sliding door locking system according to claim 1, wherein the system further comprises a lock release actuator for making an operating force for releasing a locked state act on each of the latch mechanisms, the lock release actuator being coupled to the relay lever.

* * * * *